United States Patent [19]

Wakatake

[11] 4,264,906

[45] Apr. 28, 1981

[54] DISPLAY ELEMENT AND DISPLAY PANEL EMPLOYING SUCH DISPLAY ELEMENTS

[76] Inventor: Yoshimasa Wakatake, No. 405, 9-5 Tamagawa 1-chome, Setagaya-ku, Tokyo, Japan

[21] Appl. No.: 40,403

[22] Filed: May 18, 1979

[30] Foreign Application Priority Data

May 23, 1978 [JP] Japan ..... 53/62102

[51] Int. Cl.[3] ..... G09F 9/32

[52] U.S. Cl. ..... 340/764; 340/783; 40/447

[58] Field of Search ..... 340/764, 783, 763, 756; 40/447, 449

[56] References Cited

U.S. PATENT DOCUMENTS

| | | | |
|---|---|---|---|
| 3,267,455 | 8/1966 | McGuire et al. | 340/764 |
| 3,267,595 | 8/1966 | Levy et al. | 340/764 |
| 3,469,258 | 9/1969 | Winrow | 340/764 |
| 3,659,366 | 5/1972 | Woolfolk | 40/447 |
| 3,685,040 | 8/1972 | Hart | 340/783 |
| 3,924,226 | 12/1975 | Lacy et al. | 340/764 |
| 3,949,392 | 4/1976 | Caritato | 340/764 |

*Primary Examiner*—Marshall M. Curtis

*Attorney, Agent, or Firm*—Gerald J. Ferguson, Jr.; Joseph J. Baker

[57] ABSTRACT

A display element for use with a display panel which includes a display surface structure having a number of such elements arranged in a vertical plane and each adapted for rotation about support arms provided on the opposite side surfaces thereof, thereby producing a display of a character, graph, pattern or the like on the display surface structure. The display element is formed with a plate-like (or four-cornered) block member having two (or four) display surfaces of different colors and one (or three) magnetic pieces.

8 Claims, 11 Drawing Figures

DISPLAY ELEMENT AND DISPLAY PANEL EMPLOYING SUCH DISPLAY ELEMENTS

BACKGROUND OF THE INVENTION

1. Field of the Invention

This invention relates to a display element for use in a display panel which has a number of such display elements arranged in the same vertical plane to provide a display of a character, graph, pattern or the like, and it also pertains to such a display panel.

2. Description of the Prior Art

Display panels, which have a large number of display elements disposed in the same vertical plane to produce a character, graph, pattern or like display, are now employed for providing a display of a traffic sign, directional sign, advertisement, time, date or like information. The display elements used in the past are usually formed with electrophoto conversion elements and hence cause much power consumption in the display panel. Further, the conventional display elements are readily broken by an external force and short-lived, so that the display panel employing such display elements cannot be used without failure for a long time.

SUMMARY OF THE INVENTION

Accordingly, this invention is to provide a novel display element which can be applied to construct a display panel which includes a number of such display elements arranged in the same vertical plane and which is capable of providing a character, graph, pattern or like display without much power consumption and with a long life.

DESCRIPTION OF THE PREFERRED EMBODIMENTS

Figure 1:
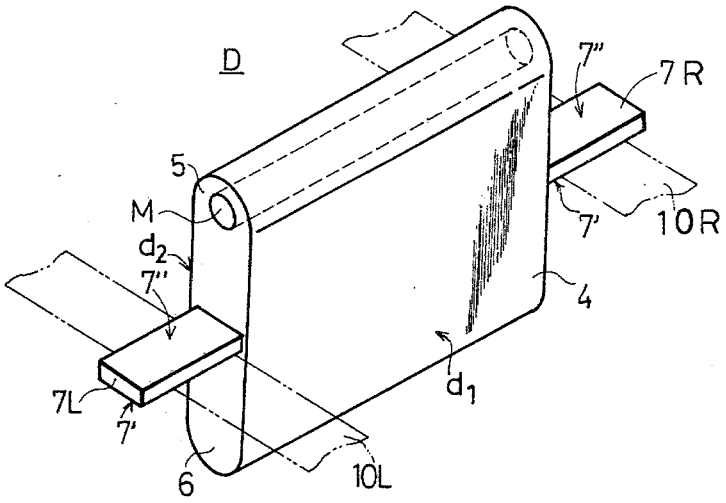
FIG. 1 is a perspective view schematically showing a first embodiment of the display element of this invention.

FIG. 1 illustrates a first embodiment of a display element according to this invention, which is indicated generally by D. The display element D is comprised of a plate-like block 4 made as of a synthetic resinous material and having a pair of opposing display surfaces $d_1$ and $d_2$ of different colors, for example, red and white, a magnetic piece M embedded in one of upper and lower end portions 5 and 6 of the display surfaces $d_1$ and $d_2$, for instance, in the upper end portion 5 to extend laterally, and left and right support arms 7L and 7R formed integrally with the plate-like block 4 centrally thereof to extend out from its left and right sides in a horizontal direction. The left and right support arms 7L and 7R are each composed of a flat plate having a pair of opposing support surfaces 7' and 7'' perpendicular to the display surfaces $d_1$ and $d_2$ of the plate-like block 4; thus, when the plate-like block 4 is supported with the support surfaces 7' or 7'' of the left and right supports 7L and 7R resting on horizontal supports 10L and 10R such as indicated by the chain lines respectively, the display surfaces $d_1$ and $d_2$ lie in vertical planes.

Figure 2:
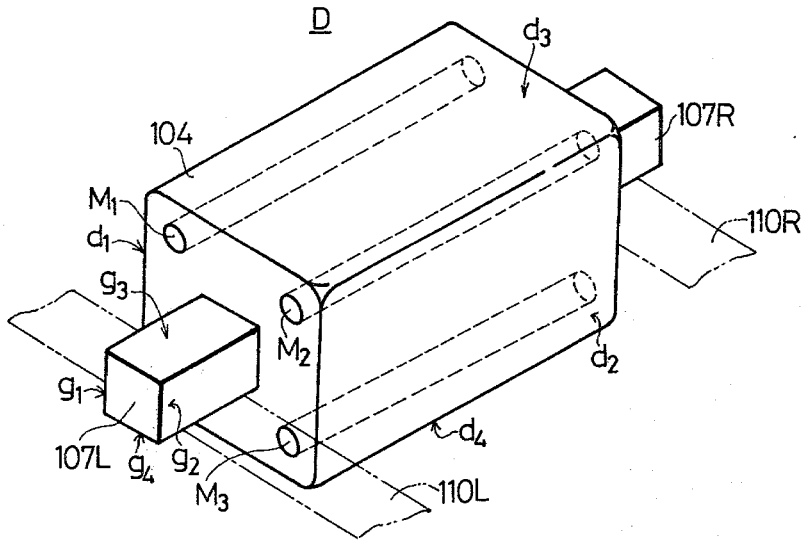
FIG. 2 is a perspective view schematically illustrating a second embodiment of the display element of this invention.

Turning now to FIG. 2, there is shown a second embodiment of the display element of this invention which is also indicated generally by D. In this embodiment, the display element D comprises a rectangular block 104 of a square cross section having two pairs of opposing display surfaces $d_1$ and $d_2$, and $d_3$ and $d_4$ of different colors, magnetic pieces $M_1$ to $M_3$ buried in the rectangular block 104 at corners to extend laterally except at a corner between the display surfaces $d_1$ and $d_4$, and left and right support arms 107L and 107R formed integrally with the rectangular block 104 centrally thereof to extend out from its left and right sides in a horizontal direction. Each of the left and right support arms 107L and 107R is a square rod of a square cross section which has a pair of opposing support surfaces $g_3$ and $g_4$ respectively perpendicular to the display surfaces $d_1$ and $d_2$ and hence parallel to the display surfaces $d_3$ and $d_4$ and a pair of opposing support surfaces $g_1$ and $g_2$ respectively perpendicular to the display surfaces $d_3$ and $d_4$ and consequently parallel to the display surfaces $d_1$ and $d_2$. The rectangular block 104 is supported with the support surfaces $g_1$, $g_2$, $g_3$ and $g_4$ individually resting on horizontal supports 110L and 110R, as indicated by the chain lines. Thus, when the support surfaces $g_3$ or $g_4$ rest on the horizontal supports 110L and 110R, the display surfaces $d_1$ and $d_2$ lie in vertical planes, whereas when the support surfaces $g_1$ or $g_2$ rest thereon, the display surfaces $d_3$ and $d_4$ lie in vertical planes.

The above has clarified the constructions of specific operative examples of the display element in accordance with the instant invention. A plurality of such display elements are arranged in the same vertical plane to provide a display panel which is designed to produce displays of letters, graphs, patterns and so forth. Now, a description will be given of how the display element of this invention is applied to such a display panel and what features the display element has in practical use.

Figures 3, 3A, 3B:
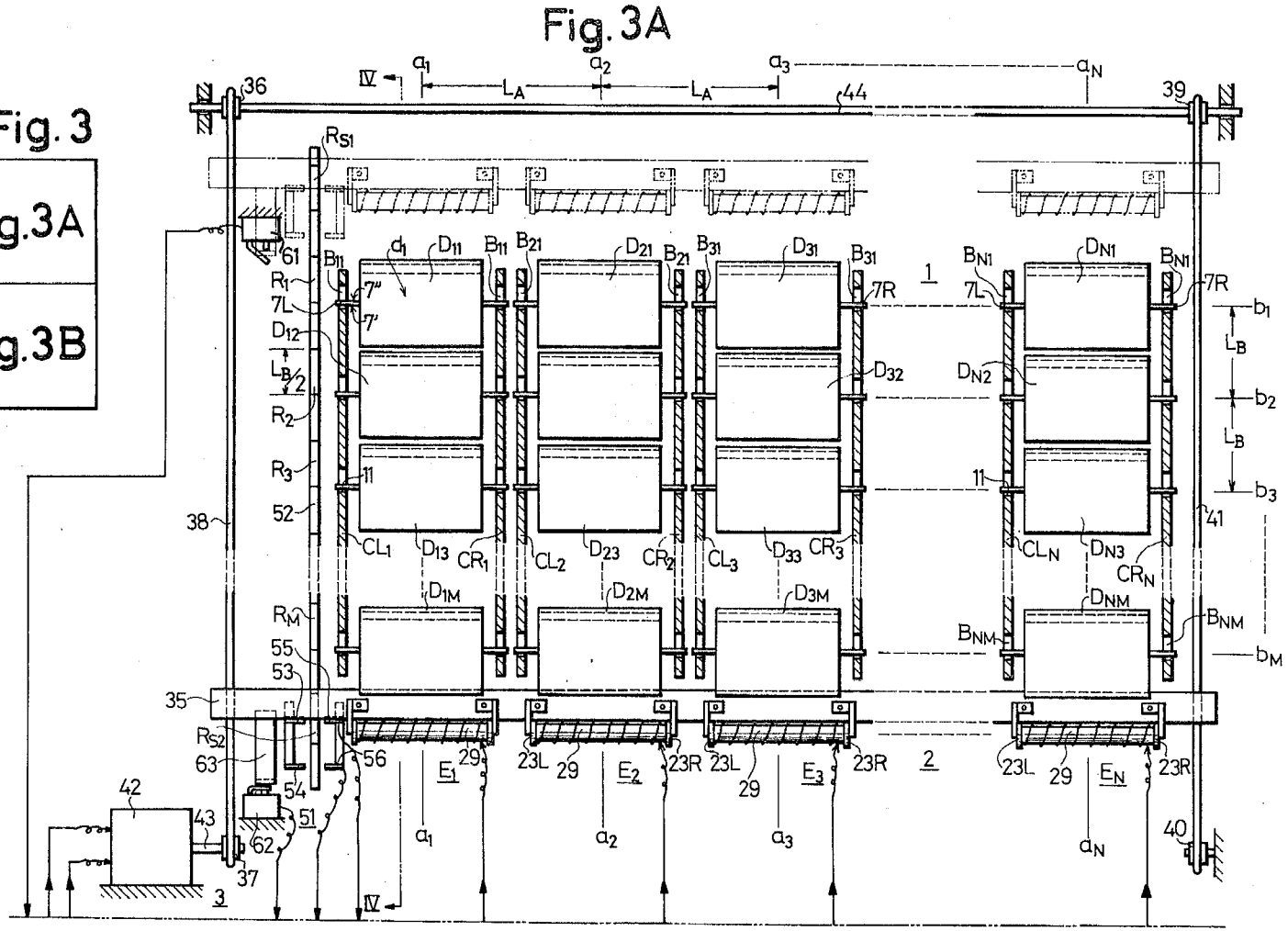
FIGS. 3, 3A and 3B, and 4 are respectively a front view of an example of a display panel employing the display elements according to the first embodiment of this invention and a sectional view of the panel taken along the line IV—IV in FIG. 3.
Figure 3B:
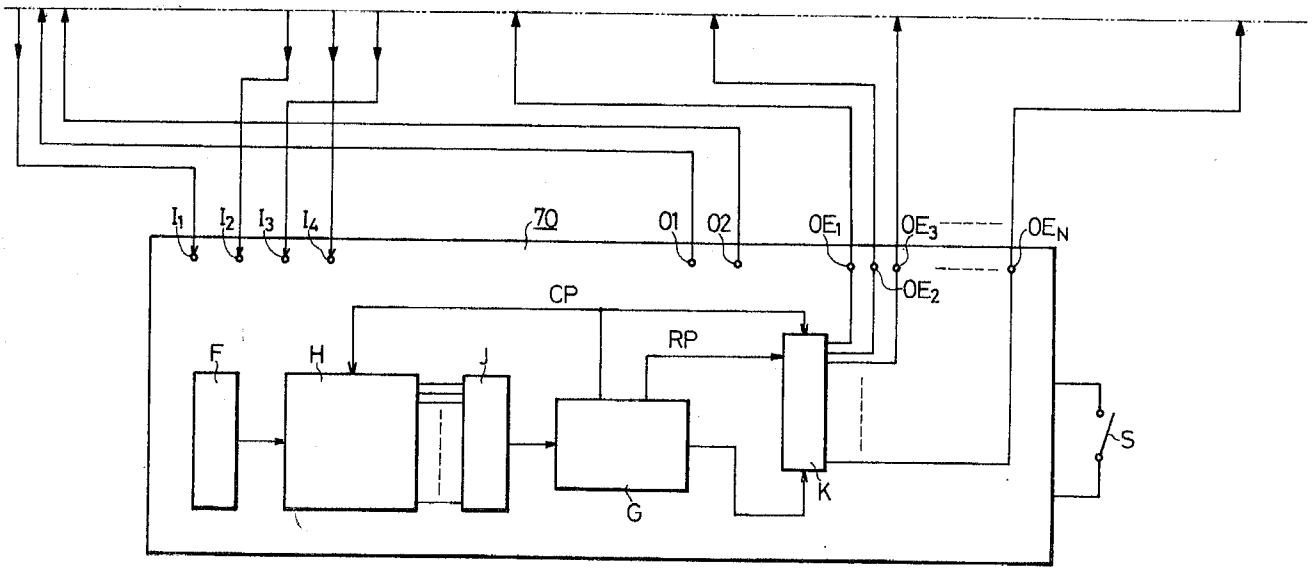
Figure 4:
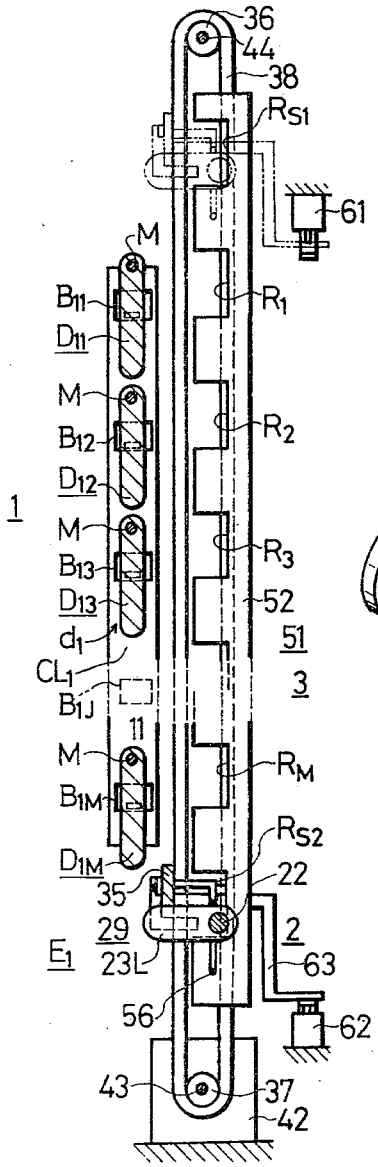

FIGS. 3 and 4 shows a display panel employing the display element D described above with respect of FIG. 1, which display panel is composed of a display surface structure 1, a display switching unit 2 and a drive unit 3.

In FIGS. 3 and 4, letting $a_1, a_2, \ldots a_N$ represent N vertical lines of arrangement spaced a predetermined distance $L_A$ apart in a horizontal direction and $b_1, b_2, \ldots b_M$ represent M horizontal lines of arrangement spaced a predetermined distance $L_B$ apart in a vertical direction, the display surface structure 1 has a display element $D_{ij}$ disposed at each intersection of the vertical and horizontal lines $a_i$ (i=1, 2, . . . N) and $b_j$ (j=1, 2, . . . M). The display element $D_{ij}$ is journalled, with the support surfaces 7'' or 7' of its left and right support arms 7L and 7R received by horizontal receiving surfaces 11 of journal holes $B_{ij}$ made in fixed support plates $CL_i$ and $CR_i$ extending in vertical directions; thereof, the display surface $d_1$ or $d_2$ of the display element $D_{ij}$ lie in a vertical plane facing forwardly. In this case, the display surface $d_1$ or $d_2$ of the display elements $D_{11}$ to $D_{N1}$, $D_{12}$ to $D_{N2}$, . . . $D_{1M}$ to $D_{NM}$ facing forwardly, lie in the same vertical plane.

Figure 5:
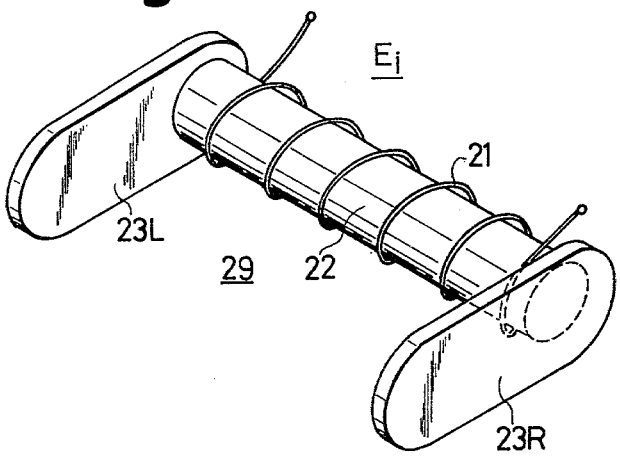
FIG. 5 is a perspective view schematically showing an example of a display control head utilized in the display panels of FIGS. 3 and 4.

An example of the display switching unit 2 has a display control head $E_i$ disposed to be movable along the aforesaid vertical line $a_i$. As clearly shown in FIG. 5, the display control head $E_i$ comprises a magnetic core 22 circular in cross section and having wound thereon a coil 21 and magnetic plates 23L and 23R respectively attached to both ends of the magnetic core 22 so that they coextend in a direction substantially perpendicular to the lengthwise direction of the magnetic core 22. The magnetic core 22 and the magnetic plates 23L and 23R makes up an electromagnet 29. In the illustrated case, the magnetic plates 23L and 23R are spaced apart a distance a little longer than the length of the aforesaid block 4 of the display element $D_{ij}$ in the lateral direction. A horizontal rod 35 is provided behind the display surface structure 1 in a manner to be movable up and down in parallel therewith. The display control head $E_i$ is mounted on the horizontal rod 35 at a position opposite the aforementioned vertical line $a_i$ with the front end faces of the magnetic plates 23L and 23R lying slightly outside the left and right sides of the block 4 of the display element $D_{ij}$, respectively. In the case of FIG. 3A, the display control head $E_i$ is positioned so that the magnetic plates 23L and 23R are disposed below and in adjacent opposing relationship with the block 4.

An example of the drive unit 3 has a belt, chain or like strap member 38 installed between a pair of pulleys 36 and 37 disposed in the vertical direction, for instance, on the left of the display surface structure 1 and spaced a predetermined distance apart and a similar strap member 41 installed between a pair of pulleys 39 and 40 likewise disposed in the vertical direction on the right of the display surface structure 1 and spaced a predetermined distance apart. The horizontal rod 35 of the abovesaid display switching unit 2 is secured at both ends to the strap members 38 and 41. A rotary shaft 43 of a motor 42 is coupled, for instance, to the pulley 37 and a shaft 44 is bridged between the pulleys 36 and 39 so that the strap members 38 and 39 may be driven by the rotation of the motor 42 up or down in synchronism with each other. Accordingly, the horizontal rod 35 is moved up and down while being held horizontal. The drive unit 3 has a detecting mechanism 51 for detecting the position of the horizontal rod 35. An example of the detecting mechanism 51 has a position detecting plate 52 which is disposed on the left hand side of the display elements $D_{11}$, $D_{12}$, . . . $D_{1M}$ to extend in the vertical direction and whose front marginal edge has rectangular recess $R_j$ formed to extend upwardly from the position corresponding to the center of the display element $D_{ij}$ in the vertical direction to a position spaced a distance equal to $\frac{1}{2}$ of the interval $L_B$ from the abovesaid position, and light emitting elements 53 and 54 and photo detectors 55 and 56 which are disposed in opposing relationship with each other with the position detecting plate 52 interposed therebetween. The photo detectors 55 and 56 each provide a detected output "1" or "0" in the binary representation depending on whether the recess $R_j$ exists or not between each of the photo detectors 55 and 56 and each of the light emitting elements 53 and 54. In practice, the position detecting plate 52 has at least the aforesaid recesses $R_1$ to $R_M$ and similar recesses $R_{S1}$ and $R_{S2}$ formed at positions spaced the distance $L_{B2}$ from the uppermost and lowermost recesses $R_1$ and $R_M$, respectively. Further, the drive unit 3 has detecting switches 61 and 62 for detecting the uppermost and lowermost positions of the horizontal rod 35, respectively. The detecting switch 61 is adapted to provide an output "1" in the binary representation upon engagement with an engaging piece 63 of the horizontal rod 35 when the magnetic pieces 23L and 23R of the display control head $E_i$ mounted on the horizontal rod 35 are moved out of the opposing relation with the display element $D_{i1}$. The detecting switch 62 is similarly adapted to provide an output "1" in the binary representation upon engagement with an engaging piece 63 of the horizontal rod 35 when the magnetic pieces 23L and 23R of the display switch $E_i$ are moved out of the opposing relation with the display element $D_{iM}$. Moreover, the drive unit 3 has a drive circuit 70 for driving the electromagnet 29 of the display control head $E_i$ of the display switching unit 2, as shown in FIG. 3B.

The drive circuit 70 comprises, for instance, a memory circuit H, an address selector circuit F, an output circuit J, a data processing circuit G and a shift register K. The memory circuit H is designed to store information "1" or "0" for selecting the display surfaces $d_1$ or $d_2$ of the display elements $D_{11}$ to $D_{N1}$, $D_{12}$ to $D_{N2}$, . . . $D_{1M}$ to $D_{NM}$ of the display elements $D_{11}$ to $D_{N1}$ in such a manner that N pieces of information of the display elements $D_{11}$ to $D_{1N}$ are stored as first parallel information at a first address, N pieces of information of the display elements $D_{12}$ to $D_{N2}$ are stored as second parallel information at a second address, . . . and N pieces of information of the display elements $D_{1M}$ to $D_{NM}$ are stored as Mth parallel information at an Mth address. The N pieces of information making up the jth parallel information stored at the jth address selected by the address selector circuit F are read out one by one upon each occurrence of a read control pulse from the data processing circuit G. The address selector circuit F is adapted to sequentially select the first, second, . . . Mth addresses of the memory circuit H for sequentially reading out the M pieces of parallel information stored in the memory circuit H. The output circuit J receives and outputs the N pieces of information of the jth parallel information read out of the memory circuit H. The data processing circuit G receives the sequential information from the output circuit J to generate pulses upon each reception of the information, which pulses are applied as a read control pulse and a shift pulse to the memory circuit H and the shift register K, respectively. The data processing circuit G is also adapted to provide a reset pulse RP for resetting the shift register K. The shift register K has first to Nth digits and is designed so that the N pieces of information successively applied from the data processing circuit G are stored at the N digits, respectively, and are simultaneously read out thereof. Further, the drive circuit 70 has input terminals I1 and I2 supplied with the detected outputs from the aforesaid detecting switches 61 and 62, respectively, input terminals I3 and I4 supplied with the detected outputs from the photo detectors 55 and 56, respectively, output terminals O1 and O2 connected to forward and backward revolution input sides of the motor 42, respectively, an output terminal $OE_i$ connected to the coil 21 of the electromagnet 29 of the display control head $E_i$ and a power source switch S. When the horizontal rod 35 of the display switching unit 2 lies at its lowermost position to maintain the detecting switch 62 in its ON state, if the power source switch S is turned on for a very short period of time, an output signal is derived from the output terminal O1. While the output signal is available from the output terminal O1, if the detected output "1" in the binary representation is supplied from the photo detector 55 to the input terminal I3, N pieces of information "1" in the binary representation and N pulses CP are successively provided from the data processing circuit G and the shift register K is sequentially shifted upon occurrence of each of the N pulses CP, with the result that the N pieces of information "1" are stored in the N digits of the shift register K. Then, when the detected output from the photo detector 55 becomes "0", the N pieces of information stored in the shift register K are derived at the output terminals $OE_1$ to $OE_N$, respectively. Then, when the output from the photo detector 55 is altered to "1", no outputs are provided at the output terminals $OE_1$ to $OE_N$ and, at the same time, the shift register K is reset by the reset pulse RP to store again the N pieces of information "1" from the data processing circuit G. And then, when the output from the photo detector 55 becomes "0" again, the outputs are obtained at the output terminals $OE_1$ to $OE_N$ in the same manner as described above and thereafter the abovesaid operation is repeated. Upon application of the detected output from the detecting switch 61 to the input terminal I1, an output signal is provided at the output terminal O2 instead of at the output terminal O1. Then, when the output signal is provided at the terminal O2 while the output "0" in the binary representation is being fed to the input terminal I4 from the photo detector 56, the address selector circuit F, the memory circuit H, the data processing circuit G and the shift register K are controlled so that the N pieces of information stored in the memory circuit at the first address are sequentially read out and applied via the output circuit J to the shift register K. At the same time, the shift register K is also controlled by the N shift pulses CP so that the N pieces of information are stored in the N digits of the shift register K. Then, when the output supplied from the photo detector 56 to the input terminal I4 becomes "1", the N pieces of information stored in the N digits of the shift register K are derived at the output terminals $OE_1$ to $OE_N$, respectively. Then, when the output from the photo detector 56 is altered to "0", the information obtained at the output terminals $OE_1$ to $OE_N$ are no more obtained and, at the same time, the shift register K is reset by the reset pulse RP and then the address selector circuit F, the memory circuit H and the data processing circuit G are controlled in the same manner as described above, so that the N pieces of information stored in the memory circuit H at the second address are successively read out and stored in the shift register K. Then, when the output from the photo detector 56 becomes "1" again, the pieces of information stored in the shift register K are led out to the output terminals $OE_1$ to $OE_N$ in the same manner as described above and thereafter the abovesaid operations are repeated. Further, when the detected output "1" in the binary representation is supplied from the detecting switch 62 to the input terminal I2, no output is obtained from the output terminal O2.

The above is the construction of an example of the display panel employing the display element D of the first embodiment of this invention. With such an arrangement, by turning on the power source switch S of the drive circuit 70 of the drive unit 3 for a very short period of time, with the horizontal rod 35 of the display switching unit 2 lying at its lowermost position to hold the detecting switch 62 in the ON state, an output is provided from the output terminal O1, whereby the motor 42 is driven in its forward direction so that the strap members 38 and 41 are driven clockwise as viewed in FIG. 4 to move the horizontal rod 35 upwardly. When the horizontal rod 35 is thus moved up, the photo detector 55 is in facing relationship with the recess $R_{S2}$ of the position detecting plate 52 to receive light therethrough from the light emitting element 53; thus an output "1" is obtained from the photo detector 55 and, in accordance with this, the information "1" from the data processing circuit G is stored in all of the digits of the shift register K of the drive circuit 70. Then, when the horizontal rod 35 is further moved, the photo detector 55 is brought into the opposing relation to the portion between the recesses $R_{S2}$ and $R_M$ to intercept the light from the light emitting element 53; consequently, the output from the photo detector 55 becomes "0" so that outputs are derived from the output terminals $OE_1$ to $OE_N$ as described above, energizing the electromagnets 29 of the display control heads $E_1$ to $E_N$. In such a state, the electromagnets 29 of the display control heads $E_1$ to $E_N$ lie opposite the lower end portions of the display elements $D_{1M}$ to $D_{NM}$ so that if the display element $D_{iM}$ is assumed to lie with its magnetic piece M held at the lowered position, that is, with the display surface $d_2$ held on the front side of the plate-like member 4, the magnetic piece M of the display element $D_{iM}$ is attracted by the electromagnet 29 of the display control head $E_i$, thus resulting in the dispaly elements $D_{iM}$ being turned. Then, when the horizontal rod 35 is further moved up, the photo detector 55 is now brought into opposing relation to the recess $R_M$ so that the photo detector 55 receives light therethrough from the light emitting element 53; thus, an output "1" is provided from the photo detector 55 with the result that no outputs are obtained from the output terminals $OE_1$ to $OE_N$, as described above, and the electromagnets 29 of the display control heads $E_1$ to $E_N$ are de-energized. In this while, the display element $D_{iM}$ is turned through 180° to have its display surface $d_1$ brought to the front. Further, N pieces of information "1" from the data processing circuit G are newly stored in the shift register K of the drive circuit 70. Thereafter, as the horizontal rod 35 moves, the display elements $D_{i(m-1)}, \ldots D_{i2}$, $D_{i1}$ are sequentially rotated through 180° only when their magnetic pieces M lie on the lower side. Consequently, by the upward movement of the horizontal rod 35, the display surfaces $d_1$ of the display elements $D_{11}$ to $D_{N1}$, $D_{12}$ to $D_{N2}, \ldots D_{1M}$ to $D_{NM}$ are all brought to the front. When the horizontal rod 35 has reached its uppermost position to turn on the detecting switch 61 to derive therefrom the detected output "1" in the binary representation, an output is provided at the output terminal 02 of the drive circuit 70 in place of the output obtained at the output terminal 01 until then. As a consequence, the motor 42 is driven in the direction reverse to that in the abovesaid case to rotate the strap members 38 and 41 counterclockwise as viewed in FIG. 4, so that the horizontal rod 35 is moved down. Then, when the photo detector 56 is brought into opposing relation to that portion of the position detecting plate 52 between the recesses $R_{S1}$ and $R_1$ to intercept the light from light emitting element 54, an output "0" is derived from the photo detector 56 to control the memory circuit H, the address selector F, the data processing circuit G and the shift register K of the drive circuit 70, so that the first parallel information for the display elements $D_{11}$ to $D_{N1}$, stored in the memory circuit H, are read out and stored in the shift register K. Next, when the horizontal rod 35 is further moved down to such a position that the photo detector 56 faces the light emitting element 54 through the recess $R_1$ to receive light from the light emitting element 54, an output "1" is provided from the photo detector 56, so that outputs are provided from those of the output terminals $OE_1$ to $OE_N$ corresponding to those of the N pieces of information stored in the shift register K which are "1". Consequently, the electromagnets 29 of only selected one or ones of the display switches $E_1$ are energized and the magnetic pieces M of that selected one or ones of the display elements $D_{11}$ to $D_{1N}$ which lie opposite the electromagnets 29 of the selected display control heads, are attracted by the electromagnets 29 to be rotated clockwise as viewed in FIG. 4. Then, when the photo detector 56 is disposed into opposing relation to that part of the position detecting plate 52 between the recesses $R_1$ and $R_2$ to intercept the light from light emitting element 54, the output from the photo detector 56 becomes "0", so that the shift register K of the drive circuit 70 is reset and, at the same time, the second parallel information for the display elements $D_{12}$ to $D_{N2}$, stored in the memory circuit H, are read out by the address selector circuit F and are again stored in the shift register K. In this while, the selected one or ones of the display elements $D_{11}$ to $D_{N1}$ are rotated through 180° to have their display surfaces $d_2$ brought to the front side. Next, when the photo detector 56 is moved into opposing relationship with the recess $R_2$ to receive light therethrough from the light emitting element 54, outputs are obtained from that selected one or ones of the output terminals $OE_1$ to $OE_N$ of the drive circuit 70 corresponding to those of the N pieces of information stored in the shift register K which are "1", as is the case with the above and only selected ones of the display element $D_{12}$ to $D_{N2}$ are rotated clockwise as viewed in FIG. 4. Thereafter, only selected ones of the display elements $D_{13}$ to $D_{N3}$, $D_{14}$ to $D_{N4}$, . . . $D_{1M}$ to $D_{NM}$ are rotated. When the horizontal rod 35 is brought down to its lowermost position to turn on the detecting switch 62 to derive therefrom a detected output "1", the output is no more produced from the output terminal O2, stopping the motor 42 from rotating.

In accordance with the display panel employing the display elements of the first embodiment of this invention described above, all of the display surfaces $d_1$ of the display elements $D_{11}$ to $D_{N1}$, $D_{12}$ to $D_{N2}$, . . . $D_{1M}$ to $D_{NM}$ can be made to face forwardly and once information of a desired pattern is stored in the memory circuit of the drive circuit 70, the display surfaces $d_2$ of desired ones of the display elements can be made to face forwardly, so that a desired character, symbol, graph, pattern or the like can be displayed with the display surfaces $d_1$ and $d_2$ of the elements $D_{11}$ to $D_{N1}$, $D_{12}$ to $D_{N2}$, . . . $D_{1M}$ to $D_{NM}$, and such a display can be produced with a simple construction. Further, since the display element $D_{ij}$ has such a simple construction that the magnetic piece M is embedded at one corner of the plate-like block 4 having the pair of opposing display surfaces $d_1$ and $d_2$ and that the left and right support arms are provided on the plate-like block 4 so as to make the display surfaces $d_1$ and $d_2$ lie in the vertical planes when the plate-like block 4 is supported, the distance between adjacent ones of the display elements can be made small; therefore, the overall apparatus can be simplified in construction and reduced in size correspondingly.

Moreover, as the display element is free from power dissipation, the display panel does not consume much power and, in addition, as the display element is not readily broken by an external force, the display panel can be used without trouble for a long time.

As will be appreciated from the above, the display element according to the first embodiment of this invention can be applied to construct a display panel which includes a number of such display elements arranged in the same vertical plane and which is capable of providing a character, graph, pattern or like display without much power consumption and with a long life.

A description will next be made of how the display element according to the second embodiment of this invention is applied to the display panel and what advantages the display element exhibits when put to practical use.

Figures 6, 6A, 6B:
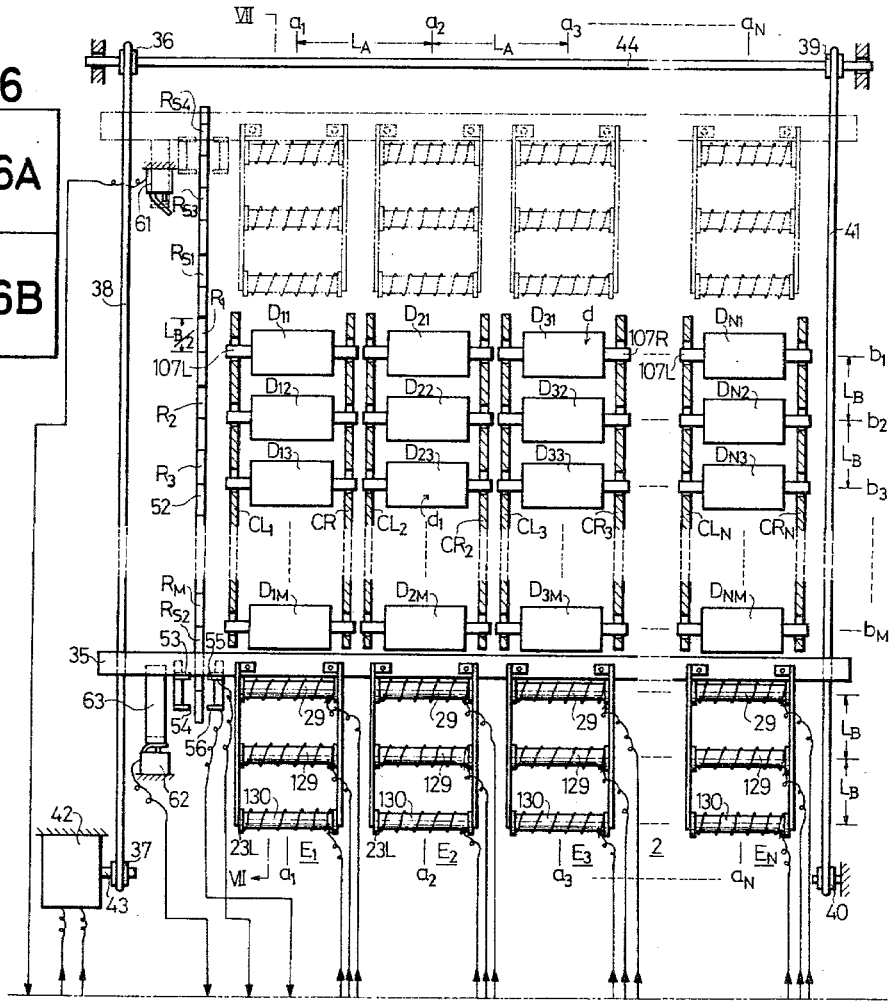
FIGS. 6, 6A and 6B, and 7 are respectively a front view of an example of a display panel employing the display elements according to the second embodiment of this invention and a sectional view of the panel taken along the line VII—VII in FIG. 6A.
Figure 6B:
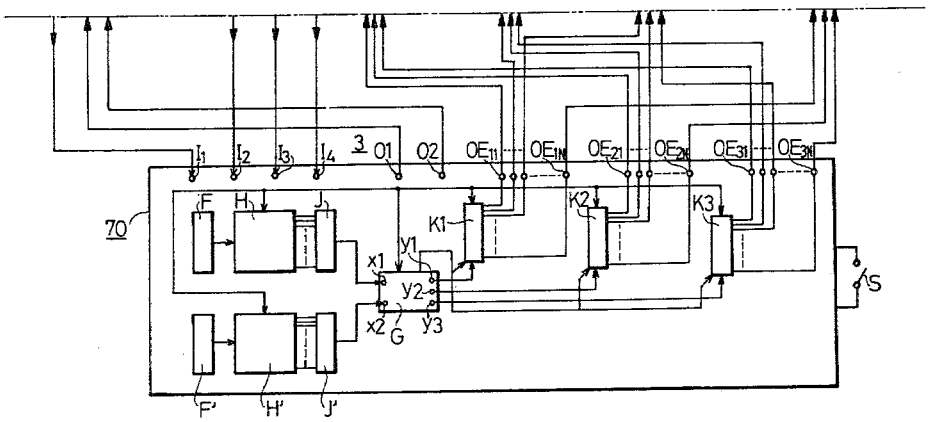
Figure 7:
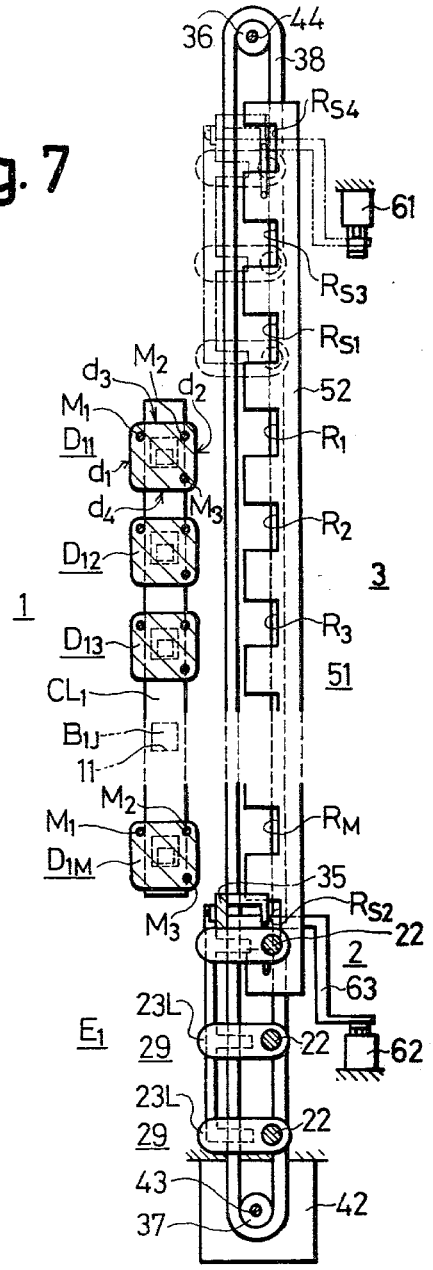

FIGS. 6 and 7 illustrate a display panel employing the display element D according to the second embodiment of this invention. In FIGS. 6 and 7, the parts corresponding to those in FIGS. 3 and 4 are marked with the same reference numerals and characters, and no detailed description will be repeated. The display element of FIGS. 6 and 7 is identical in construction with that shown in FIGS. 3 and 4 except for the following differences in the display element $D_{ij}$ of the display surface structure 1, the display control head $E_i$ of the display switching unit 2 and the drive circuit 70 of the drive unit 3. In the display panel shown in FIGS. 6 and 7, the display element D according to the second embodiment of this invention described above in connection with FIG. 2 is employed as the display element $D_{ij}$ of the display surface structure.

The display control head $E_i$ of the display switching unit 2 has the aforesaid electromagnet 29 and two other ones 129 and 130 similar thereto, the electromagnets 29, 129 and 130 being arranged downwardly in this order at the intervals $L_B$ referred to previously with respect of FIGS. 3 and 4.

Further, the drive circuit 70 of the drive unit 3 has another set of a memory circuit H', an address selector circuit F' and an output circuit J' in addition to the set of the memory circuit H, the address selector circuit F and the output circuit J. The data processing circuit G has two information input terminals x1 and x2 and three information output terminals y1, y2 and y3 and is adapted so that the information from the output circuits J and J' may be supplied to the information input terminals x1 and x2, respectively. Moreover, three shift registers K1, K2 and K3 are provided and information from the information output terminals y1, y2 and y3 of the data processing circuit G are applied to information input terminals of the shift registers K1, K2 and K3, respectively. The output terminals $OE_1$ to $OE_N$ are omitted but instead three sets of output terminals $OE_{11}$ to $OE_{1N}$, $OE_{21}$ to $OE_{2N}$ and $OE_{31}$ to $OE_{3N}$ are provided, the output terminal $OE_{1i}$ being connected to the electromagnet 130 of the display control head $E_i$, the output terminal $OE_{2i}$ to the electromagnet 129 and the output terminal $OE_{3i}$ to the electromagnet 29. When an output "1" in the binary representation is supplied to the input terminal I3 from the photo detector 55 in the state that an output is obtained from the output terminal O1, information "1" in the binary representation and the clock pulse CP are sequentially derived from the output terminals y1, y2 and y3 of the data processing circuit G and the information "1" from the output terminals y1, y2 and y3 are respectively stored in the shift registers K1, K2 and K3 upon each occurrence of the clock pulse CP. Then, when the output from the photo detector 55 becomes "0", the information stored in the shift registers K1, K2 and K3 are led out to the output terminals $OE_{11}$ to $OE_{1N}$, $OE_{21}$ to $OE_{2N}$ and $OE_{31}$ to $OE_{3N}$ and then when the output from the photo detector 55 is altered to "1", such outputs are no more provided at the output terminals $OE_{11}$ to $OE_{1N}$, $OE_{21}$ to $OE_{2N}$ and $OE_{31}$ to $OE_{3N}$. At the same time, the shift registers K1, K2 and K3 are reset to provide again the outputs "1" from the output terminals y1, y2 and y3 of the data processing circuit G and these outputs are stored in the shift registers K1, K2 and K3. Then, when the output from the photo detector 55 becomes "0" again, outputs are provided from the output terminals $OE_{11}$ to $OE_{1N}$, $OE_{21}$ to $OE_{2N}$ and $OE_{31}$ to $OE_{1N}$ as in the above and thereafter such operations are repeated. Further, upon application of the detected output from the detecting switch 61 to the input terminal I1, an output is derived from the output terminal O2 instead of from the output terminal O1. When an output "0" in the binary representation is supplied to the input terminal I4 from the photo detector 56 in the state that the output is provided at the output terminal O2, the address selector circuits F and F', the memory circuits H and H', the data processing circuit G and the shift registers K1, K2 and K3 are controlled so that information stored in the memory circuits H and H' are supplied via the output circuits J and J' to the data processing circuit G. The data processing circuit G provides at its output terminals y1, y2 and y3 information "0", "0" and "0", respectively, in the case of the information from the memory circuits H and H' being "0" and "0", and information "1", "0" and "0" in the case of the latter information being "0" and "1". When the information from the memory circuits H and H' and "1" and "0", the data processing circuit G provides information "1", "0" and "0" at its output terminals y1, y2 and y3, respectively, and then if an output "0" in the binary representation is provided from the photo detector 56 in the above state, the information "1", "0" and "0" at the output terminals y1, y2 and y3 change to "0", "1" and "0", respectively. In the case of the information from the memory circuits H and H' being "1" and "1", the data processing circuit G provides information "1", "0" and "0" and then, if the output "0" is obtained from the photo detector 56 in the above state, the information at the output terminals y1, y2 and y3 change to "0", "1" and "0", respectively, and thereafter, if the output "0" is derived from the photo detector 56 in this state, the information at the above-said three output terminals change to "0", "0" and "1", respectively. The information thus obtained are successively stored in the shift registers K1, K2 and K3. Then, when the output from the photo detector 56 to be supplied to the input terminal I4 becomes "1", the information stored in the shift registers K1, K2 and K3 are derived at the output terminals $OE_{11}$ to $OE_{1N}$, $OE_{21}$ to $OE_{2N}$ and $OE_{31}$ to $OE_{3N}$, respectively. And then, when the output from the photo detector 56 is altered to "0", no outputs are provided at the output terminals $OE_{11}$ to $OE_{1N}$, $OE_{21}$ to $OE_{2N}$ and $OE_{31}$ to $OE_{3N}$. At the same time, the shift registers K1, K2 and K3 are reset and, as described above, the address selector circuits F and F', the memory circuits H and H', the data processing circuit G and the shift registers K1, K2 and K3 are respectively controlled so that information stored at the next address is successively read out of the memory circuits H and H', and, as is the case with the above, the data processing circuit G is actuated and the information therefrom are stored in the shift registers K1, K2 and K3, respectively. Then, when the output from the photo detector 56 is altered again to "1", the information stored in the shift registers K1, K2 and K3 are derived at the output terminals $OE_{11}$ to $OE_{1N}$, $OE_{21}$ to $OE_{2N}$ and $OE_{31}$ to $OE_{3N}$, respectively, in the same manner as mentioned above and thereafter such operations are repeated. Further, the position detecting plate 52 of the detecting mechanism 51 of the drive unit 3 has formed therein recesses $R_{S3}$ and $R_{S4}$ similar to those $R_j$, $R_{S1}$ and $R_{S2}$ at the positions above the recess $R_{S1}$ and spaced therefrom the distances $L_B/2$.

The above is the construction of another example of the display panel employing the display elements of the second embodiment of this invention. With such a construction, by turning on the power source switch S of the drive circuit 70 of the drive unit 3 for a very short period of time with the horizontal rod 35 of the display switching unit 2 being located at its lowermost position to hold the detecting switch 62 in its ON state, the horizontal rod 35 is moved up as in the case described above with respect to FIGS. 4 and 5. Each time an output "1" is provided from the photo detector 55, information "1" from the data processing circuit G are stored in the shift registers K1, K2 and K3 of the drive circuit 70, respectively. And each time the photo detector 55 provides an output "0", the information stored in the shift registers are led out to the output terminals $OE_{11}$ to $OE_{1N}$, $OE_{21}$ to $OE_{2N}$ and $OE_{31}$ to $OE_{3N}$, respectively, and supplied to the electromagnets 29, 129 and 130 of the display control head $E_1$ to $E_N$ of the display switching unit 2 to energize them. When the display surface $d_1$ of the display element $D_{ij}$ of the display surface structure 1 lies on the front side as shown in FIG. 7, the magnetic piece $M_3$, which is at the rear lower end portion, is attracted by the electromagnet 29 upon energization thereof so that the display element $D_{ij}$ is rotated through 90°. Such rotation results in no magnetic piece being lying at the rear lower end portion; thus, the display element $D_{ij}$ will not be rotated when the electromagnet 129 or 130 is brought into opposing relationship thereto. Accordingly, the display element $D_{ij}$ remains in its display state with the display surface $d_3$ retained on the front side. Where the display surface $d_4$ is on the front side, the magnetic piece $M_2$ lies at the rear lower end portion, so that it is attracted first by the electromagnet 29 to turn the display element $D_{ij}$ through 90°. After this rotation, since the magnetic piece $M_3$ stays at the rear lower end portion, it is attracted by the next electromagnet 129 to rotate the display element $D_{ij}$ through 90°. Also after this rotation, no magnetic piece exists at the rear lower end portion, so that even if the next electromagnet 130 arrives at the position opposite the display element $D_{ij}$, the latter will not be turned but will remain in its display state with the display surface $d_3$ held on the front side. Where the display surface $d_2$ lies on the front side, the magnetic piece $M_1$ exists at the rear lower end portion and is attracted first by the electromagnet 29 to turn the display element $D_{ij}$ through 90°. Also in this case, the magnetic piece $M_2$ still exists at the rear lower end portion and is attracted by the next electromagnet 129 to further rotate the display element $D_{ij}$ through 90°, bringing the magnetic piece $M_3$ to the lower end portion of display element $D_{ij}$ on the rear side thereof. The magnetic piece $M_3$ is attracted by the next electromagnet 130 to turn the display element $D_{ij}$ through 90° to provide the display state in which the display surface $d_3$ stays on the front side. Where the display surface $d_3$ lies on the front side, since no magnetic piece exists at the lower end portion of the display element $D_{ij}$ on the rear side thereof, the display element $D_{ij}$ will not be rotated by any of the electromagnets 29, 129 and 130 but will remain in the display state that the display surface $d_3$ is retained on the front side. Consequently, by the upward movement of the horizontal rod 35, the display elements $D_{11}$ to $D_{N1}$, $D_{12}$ to $D_{N2}$, . . . $D_{1M}$ to $D_{NM}$ are all brought into their display state that their display surfaces $d_3$ are held on the front side. When the horizontal rod 35 reaches its uppermost position to turn on the detecting switch 61, the horizontal rod 35 is brought down in the same manner as described previously with regard to FIGS. 4 and 5. And each time an output "0" is derived from the photo detector 56, the address selector circuits F and F', the memory circuits H and H', the data processing circuit G and the shift registers K1, K2 and K3 of the drive circuit 70 are controlled to selectively energize the electromagnets 29, 129 and 130 of a selected one or ones of the display control heads $E_1$ to $E_N$ of the display switching unit 2 in accordance with the memory contents of the memory circuits H and H'. Thus, a selected one or ones of the display elements $D_{11}$ to $D_{N1}$, $D_{12}$ to $D_{N2}$, . . . $D_{1M}$ to $D_{NM}$ are rotated to bring a predetermined one of the display surfaces $d_1$, $d_2$ and $d_4$ to the front side. When the horizontal rod 35 is moved down to its lowermost position to turn on the detecting switch 62 to derive therefrom a detected output "1", the motor 42 is stopped from rotating as in the case described previously with respect of FIGS. 4 and 5.

In accordance with the display panel using the display elements according to the above second embodiment of this invention, the display surfaces $d_3$ of all the display elements $D_{11}$ to $D_{N1}$, $D_{12}$ to $D_{N2}$, . . . $D_{1M}$ to $D_{NM}$ can be made to face forwardly and a desired one of the display surfaces $d_1$, $d_2$ and $d_4$ of a desired one or ones of the display elements can be made to face forwardly. Accordingly, if the display surfaces $d_3$, $d_1$, $d_2$ and $d_4$ of the display elements $D_{ij}$ are previously colored, for example in white, red, green and blue, respectively, a character, symbol, graph or pattern can be displayed in colors as desired. Such a display can be produced with a simple construction as a whole.

Further, according to the display panel described above, since the display element $D_{ij}$ has the construction described previously with respect to FIG. 2, it is possible to obtain the same features as are obtainable with the display panel set forth previously in respect of FIGS. 3 and 4, although no detailed description is given.

As is apparent from the foregoing description, the display element of the second embodiment of this invention has the same features as the display element of the first embodiment.

The foregoing embodiments should be construed as being merely illustrative of this invention and should not be construed as limiting the invention specifically thereto. The display surface of the display element $D_{ij}$ may also be an arcuate or like curved surface.

It will be apparent that many modifications and variations may be effected without departing from the scope of the novel concepts of this invention.

What is claimed is:

1. A display element for a display panel, which is formed with a block member having left and right support arms extending therefrom in a horizontal direction, an outer peripheral surface forming a plurality of display surfaces of different colors to provide a plurality of corners around a line joining the left and right support arms and a magnetic piece disposed in each of the corners except one of them, wherein the left and right support arms each have a plurality of support surfaces substantially perpendicular to the display surfaces respectively, and wherein a selected one of the display surfaces is caused to lie in a vertical plane in the state of a selected one of the support surfaces of the left and right support arms being supported horizontally.

2. A display element according to claim 1, wherein the block member is plate-shaped, and hence has two corners and two display surfaces and has a magnetic piece.

3. A display element according to claim 1, wherein the block member is four-cornered, and hence has four corners and four display surfaces and has three magnetic pieces.

4. A display panel comprising:

a display surface structure;

a display switching unit; and a drive unit:

in which, letting N vertical lines of arrangement spaced a predetermined distance from adjacent ones of them in a horizontal direction be represented by $a_1$, $a_2$, . . . $a_N$, respectively, the display surface structure has M display elements $D_{i1}$, $D_{i2}$, . . . $D_{iM}$ disposed on the vertical line $a_i$ (i=1, 2, . . . N) at predetermined intervals in a vertical direction;

in which the display element $D_{ij}$ (j=1, 2, . . . M) is formed with a block member having left and right support arms extending therefrom in a horizontal direction, an outer peripheral surface forming a plurality of display surface of different colors to provide a plurality of corners around a line joining the left and right support arms and a magnetic piece disposed in each of the corners except one of them, the left and right support arms each having a plurality of support surfaces substantially perpendicular to the display surfaces respectively, and a selected one of the display surfaces being caused to lie in a vertical plane in the state of a selected one of the support surfaces of the left and right support arms being supported horizontally;

in which the display switching unit has a display control head $E_i$ disposed to be movable along the vertical line $a_1$ in the vertical direction, the display control head $E_1$ having electromagnets less than the corners of the block member by one; and in which the drive unit has means for simultaneously moving up and down the display control heads $E_i$ to $E_n$ and means for driving the electromagnets of the display control head $E_i$ in synchronism with the movement of the display control head $E_i$.

5. A display panel according to claim 4, wherein the block member forming the display element $D_{ij}$ is plate-shaped, and hence has two corners and two display surfaces and has one magnetic piece, and wherein the display control head $E_i$ has one electromagnet.

6. A display panel according to claim 4, wherein the block member forming the display element $D_{ij}$ is a four-cornered block member, and hence has four-corners and four display surfaces and has three magnetic pieces embedded in the three ones of the four corners respectively, and wherein the display control head $E_i$ has one electromagnet.

7. A display panel according to claim 4, wherein the block member forming the display element $D_{ij}$ is a four-cornered block member, and hence has four-corners and four display surfaces and has three magnetic pieces embedded in the three ones of the four corners respectively, and wherein the display control head $E_i$ has three electromagnets.

8. A display panel according to claim 4, wherein the display control head $E_i$ comprises a magnetic core and a pair of magnetic plates attached to the opposite ends of the magnetic core respectively, the pair of magnetic plates being spaced apart from each other a distance slightly greater than the length of the block member.

* * * * *